US010561959B1

(12) United States Patent
Tasbas

(10) Patent No.: US 10,561,959 B1
(45) Date of Patent: Feb. 18, 2020

(54) BUILDING BLOCK SYSTEM

(71) Applicant: Walter Tasbas, Williamson, NY (US)

(72) Inventor: Walter Tasbas, Williamson, NY (US)

( * ) Notice: Subject to any disclaimer, the term of this patent is extended or adjusted under 35 U.S.C. 154(b) by 0 days.

(21) Appl. No.: 16/250,444

(22) Filed: Jan. 17, 2019

(51) Int. Cl.
*A63H 33/04* (2006.01)
*A63H 33/10* (2006.01)

(52) U.S. Cl.
CPC ..... *A63H 33/101* (2013.01); *A63H 33/042* (2013.01)

(58) Field of Classification Search
CPC .... A63H 33/00; A63H 33/101; A63H 33/102; A63H 33/04; A63H 33/06; A63H 33/08; A63H 33/10; A63H 33/106–108; A63H 33/086; A63H 33/088
USPC ..... 446/120–122, 124–126, 128
See application file for complete search history.

(56) References Cited

U.S. PATENT DOCUMENTS 5,372,450 A * 12/1994 Blodgett ..... A63H 33/10 403/171
5,653,621 A * 8/1997 Yao ..... A63H 33/082 446/127
6,450,853 B1 * 9/2002 Larws ..... A63H 33/101 446/122
7,322,873 B2 * 1/2008 Rosen ..... A63H 33/042 446/124
7,553,209 B1 * 6/2009 Sorensen ..... A63H 33/06 446/124
7,976,024 B1 * 7/2011 Stapleton ..... A63H 33/065 273/156
9,345,983 B2 5/2016 Meys

* cited by examiner

*Primary Examiner* — Kien T Nguyen
(74) *Attorney, Agent, or Firm* — Dale J. Ream

(57) ABSTRACT

A building block system includes a block body having four side faces offset 90 degrees from an adjacent side face and having a side edge intermediate adjacent side faces. The block body includes a top face perpendicular to the side faces and a bottom face opposite and parallel to the top face that is perpendicular to the four side faces, the top and bottom faces having a plurality of upper and lower edges, respectively, intermediate the four side faces, respectively. The system includes a plurality of receiver members, a single receiver member being positioned on a respective the side edge and on a respective the upper edge and on a respective the bottom edge. The system includes a plurality of connector members positioned intermediate the plurality of receiver members, respectively. Each receiver member has a configuration operable to receive a respective connector member in a locking engagement.

19 Claims, 13 Drawing Sheets

20
36

38
22
22

32
34
30

BUILDING BLOCK SYSTEM

BACKGROUND OF THE INVENTION

This invention relates generally to a building block system that includes a plurality of building blocks each having a plurality of faces, receiver members, and connector members configured for connecting building blocks together.

Building block systems have been presented in the past for the personal enjoyment of building a structure step-by-step and block-by-block, such as the well known building blocks under the LEGO™ brand name. A user may choose to follow instructions for building recognizable structures or just use the user's own ingenuity to build new structures. Other building block systems have been proposed having connector pieces for joining the building blocks, such as that shown in U.S. Pat. No. 9,345,983. In either system, the result of connecting multiple blocks together is relatively structured.

Although various devices have been proposed in the commercial marketplace and patent art, the existing systems do not provide a building block system in which each block includes a plurality of faces, receiver members, and connector members configured for connecting building blocks together in more varied and even abstract configurations.

Therefore, it would be desirable to have a building block system that includes one or more blocks each that may be displayed and having both male and female connectors on an outer surface that may be interconnected with another building block.

SUMMARY OF THE INVENTION

A building block system according to a preferred embodiment includes a block body having four side faces offset about 90 degrees from an adjacent side face and having a side edge intermediate two adjacent side faces. The block body also includes a top face perpendicular to the four side faces and a bottom face opposite and parallel to the top face that is perpendicular to the four side faces, the top face and the bottom face having a plurality of upper edges and a plurality of lower edges, respectively, intermediate the four side faces, respectively. The system includes plurality of receiver members, a single receiver member being positioned on a respective the side edge and on a respective the upper edge and on a respective the bottom edge. The system includes a plurality of connector members positioned intermediate the plurality of receiver members, respectively. Each receiver member has a configuration operable to receive a respective connector member in a locking engagement.

Therefore, a general object of this invention is to provide a building block system for entertainment across age demographics and having multiple building blocks modularly connected together.

Another object of this invention is to provide a building block system, as aforesaid, in which each block body includes a plurality of connector members each having a male configuration and a plurality of receiver members each having an open interior operable to receive a connector member of another block body.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
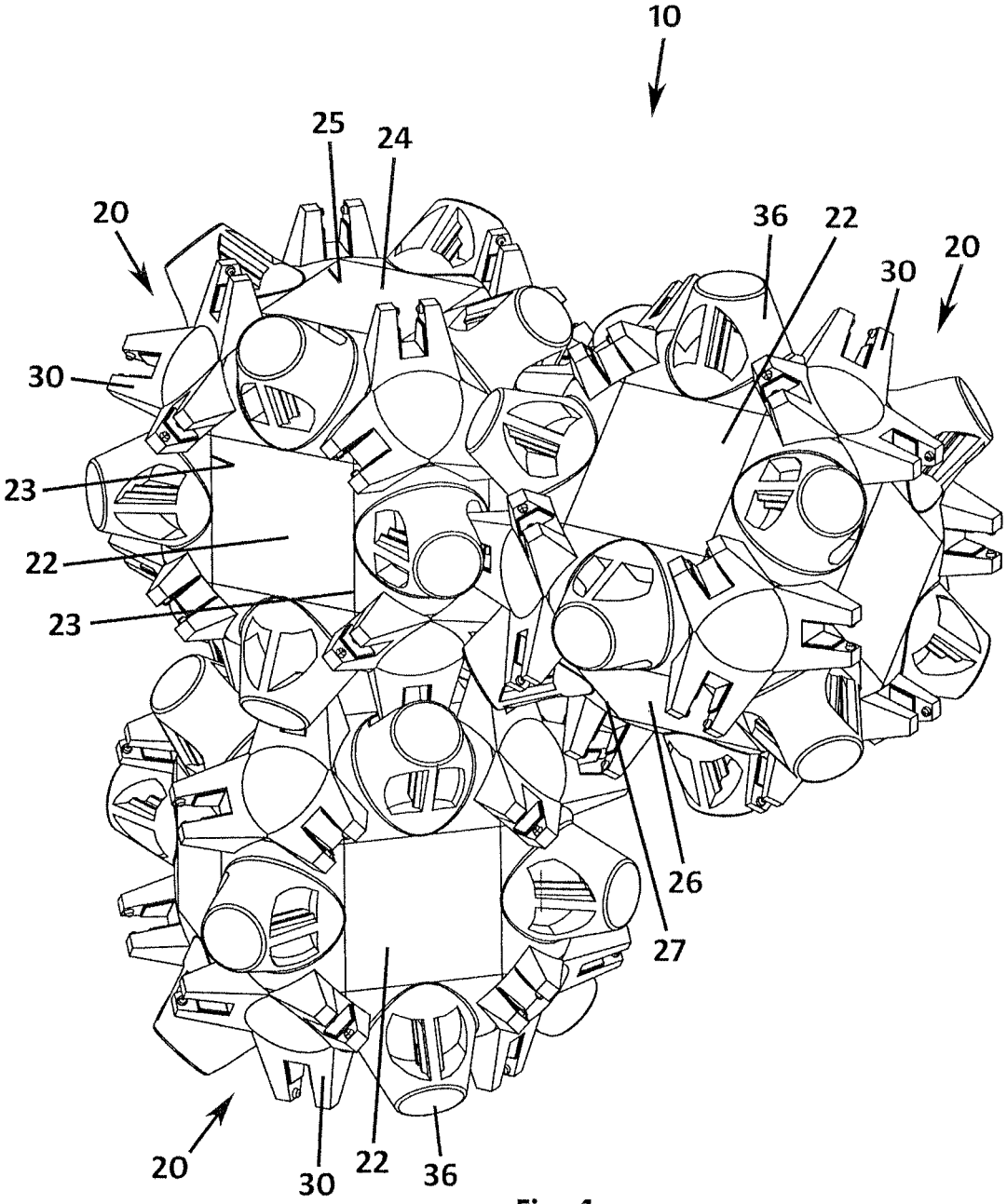
FIG. 1 is a perspective view of a building block system according to a preferred embodiment of the present invention, illustrated with a trio of building blocks coupled together.

A building block system according to a preferred embodiment of the present invention will now be described with reference to FIGS. 1 to 14 of the accompanying drawings. The building block system 10 includes a plurality building blocks each having a block body having a plurality of side faces 22, a top face 24, a bottom face 26, a plurality of connector members 30 each having a male configuration, and a plurality of receiver members 36 each having a female configuration.

Figure 2:
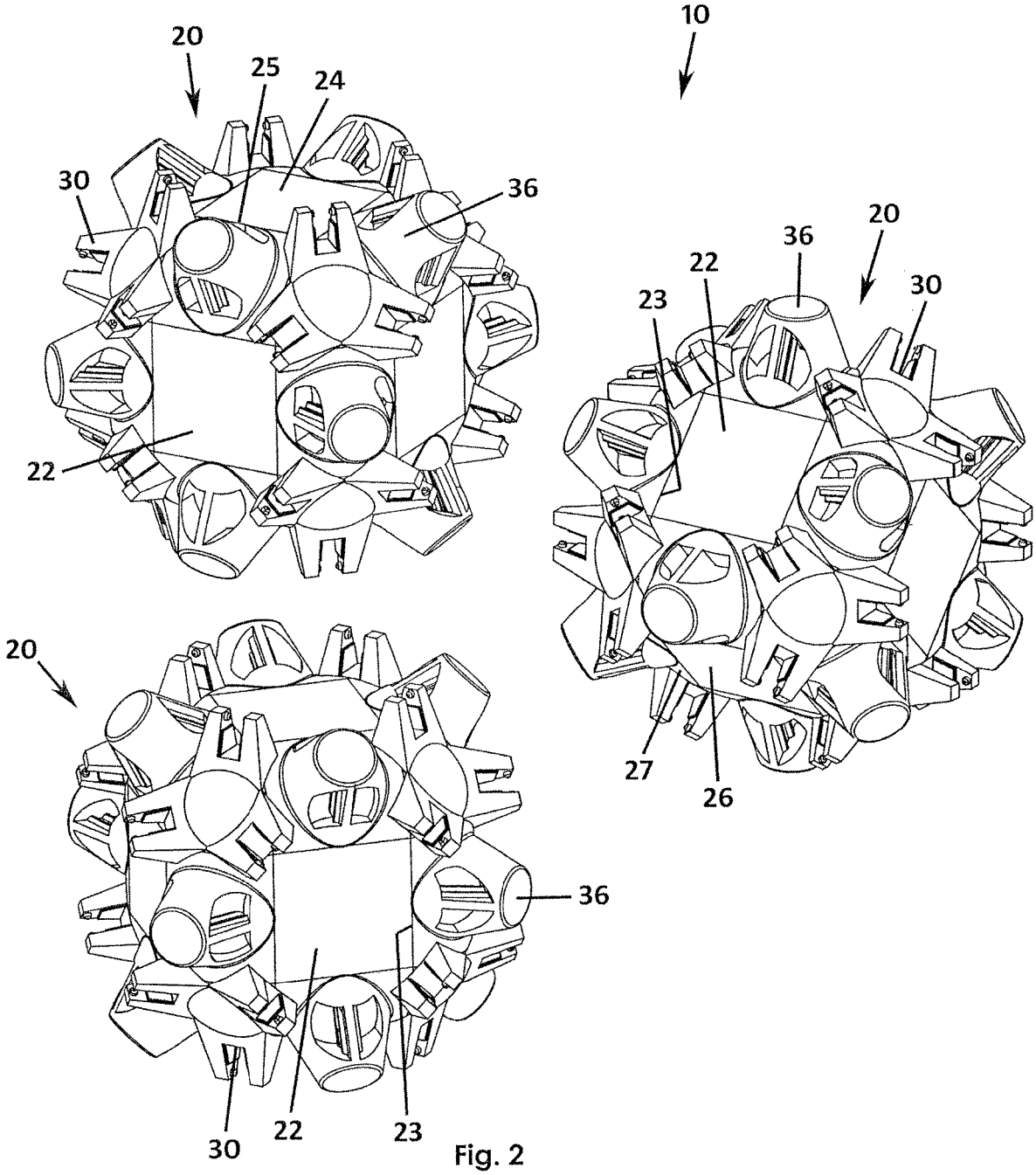
FIG. 2 is another perspective view of the building block system as in FIG. 1, illustrated with the trio of building blocks separated and independent.

The building block system 10 includes a plurality of building blocks 20, each building block 20 having a block body having the same structure such that one building block 20 may be coupled to a next building block 20 which may be coupled in like manner to a next building block 20, and so on (FIG. 1). The plurality of building blocks 20 may be separated and used individually as shown in FIG. 2 and later coupled together as will be described later. Each single building block 20 has a configuration that is substantially similar or identical to any other building block 20. More particularly, a building block 20 includes a block body having a plurality of side faces 22, a top face 24, a bottom face 26, and corresponding edges that define the contours or shape of the block body. Preferably, the block body of a building block 20 includes four (4) side faces 22 and the side faces 22, top face 24, and bottom face 26 each have a planar (flat) configuration and are arranged in a manner so that the building block 20 has a cube-shaped shape configuration. It is understood that the components of a block body may have a unitary construction, such as could be made on a 3D printer or a single mold.

Even more particularly, the four side faces 22 of a building block 20 are offset ninety degrees from one another, i.e. a situated at right angles in the form of a cube, and a side edge 23 is situated intermediate adjacent side edges. Further, an upper edge 25 is intermediate the top face 24 and each side face 22, respectively. In other words, there are four upper edges 25 each separating the top face 24 from an adjacent side face 22. Similarly, a lower edge 27 is intermediate the bottom face 26 and each side face, respectively. In other words, there are four lower edge 27 each separating the bottom face 26 from an adjacent side face 22.

In another aspect, the block body of a building block 20 may include a plurality of corner portions 28 each having a flattened configuration, i.e. a flattened or beveled surface on the otherwise cube-shaped configuration described above. Specifically, the block body may include four upper corner portions and four lower corner portions, i.e. each corner of the cube may have a flattened contour. Even more specifically, each upper corner portion is formed at the intersection of two adjacent upper edges 25 and an associated side edge 23. Similarly, each lower corner portion is formed at the intersection of two adjacent lower edge 27 and an associated side edge 23.

In another aspect, each block body includes a plurality of receiver members 36 and a plurality of connector members 30, both of which extend away from an outside surface of the block body. More particularly, each receiver member 36 includes a housing positioned on each side edge 23 of the block body and extends outwardly therefrom. A housing of a receiver member 36 is similarly positioned along each upper edge 25 and each lower edge 27. Preferably, each receiver member 36 (or housing thereof) is situated at about a midpoint of each edge, respectively, and specifically midway between respective corner portions 28 which will be described later.

The housing of a receiver member 36 defines an interior space, also referred to as a cavity. The housing includes a divider 38 and defines a pair of apertures—one on either side of the divider 38, the apertures 37 allowing access to the open interior space. A rear wall or inner wall surface of the housing defines at least one and, preferably, a plurality of ridges 39 configured and operable to receive a nub 34 extending inwardly from a prong 32 of a connector member 30 as will be described below. The receiver members 36 may, therefore, be referred to as having a female configuration.

Each connector member 30 includes a pair of prongs 32 extending outwardly from an end coupled to or integrally attached to the outer surface of a corner portion 28 of a block body of a building block 20. The pair of prongs and, therefore, the connector portions may be referred to as having a male configuration. The pair of prongs 32 are separated from and parallel to one another, each prong 32 having a semi-flexible construction, such as constructed of a plastic material, so as to flex when inserted into a housing of a receiver member 36, i.e. to flex around a respective divider 38 and to be held in a respective interior area in a friction fit engagement. A nub 34 or similar flange may extend inwardly from a free end of each prong 32 and is, therefore, perpendicular to an axis defined by a respective prong 32. Each nub 34 is dimensioned and shaped to be received in a corresponding ridge 39 defined by a rear wall of the housing of a respective receiver member 36.

Figure 3:
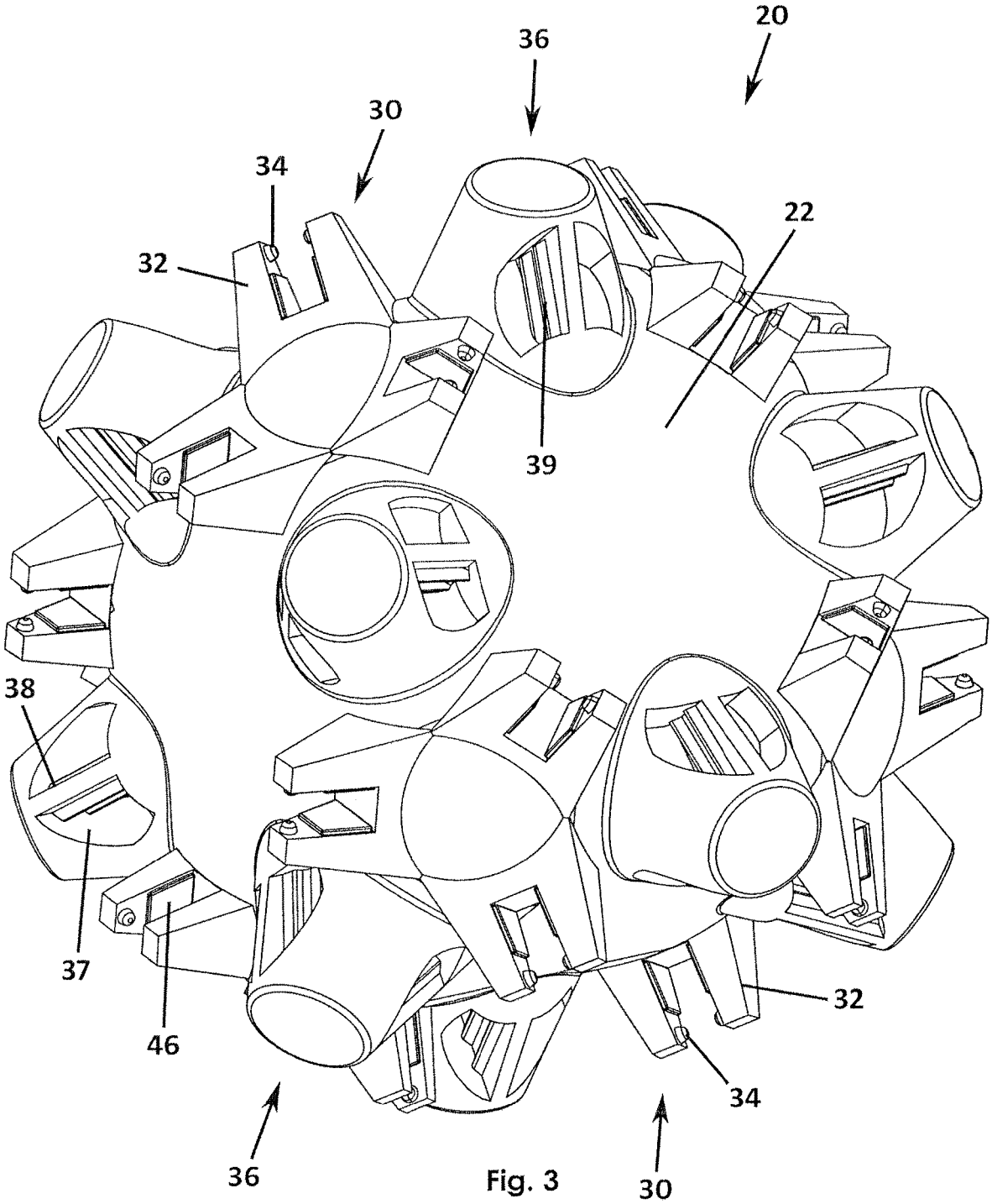
FIG. 3 is a perspective view on an enlarged scale of a single building block according to the present invention.
Figures 4, 5, 6:
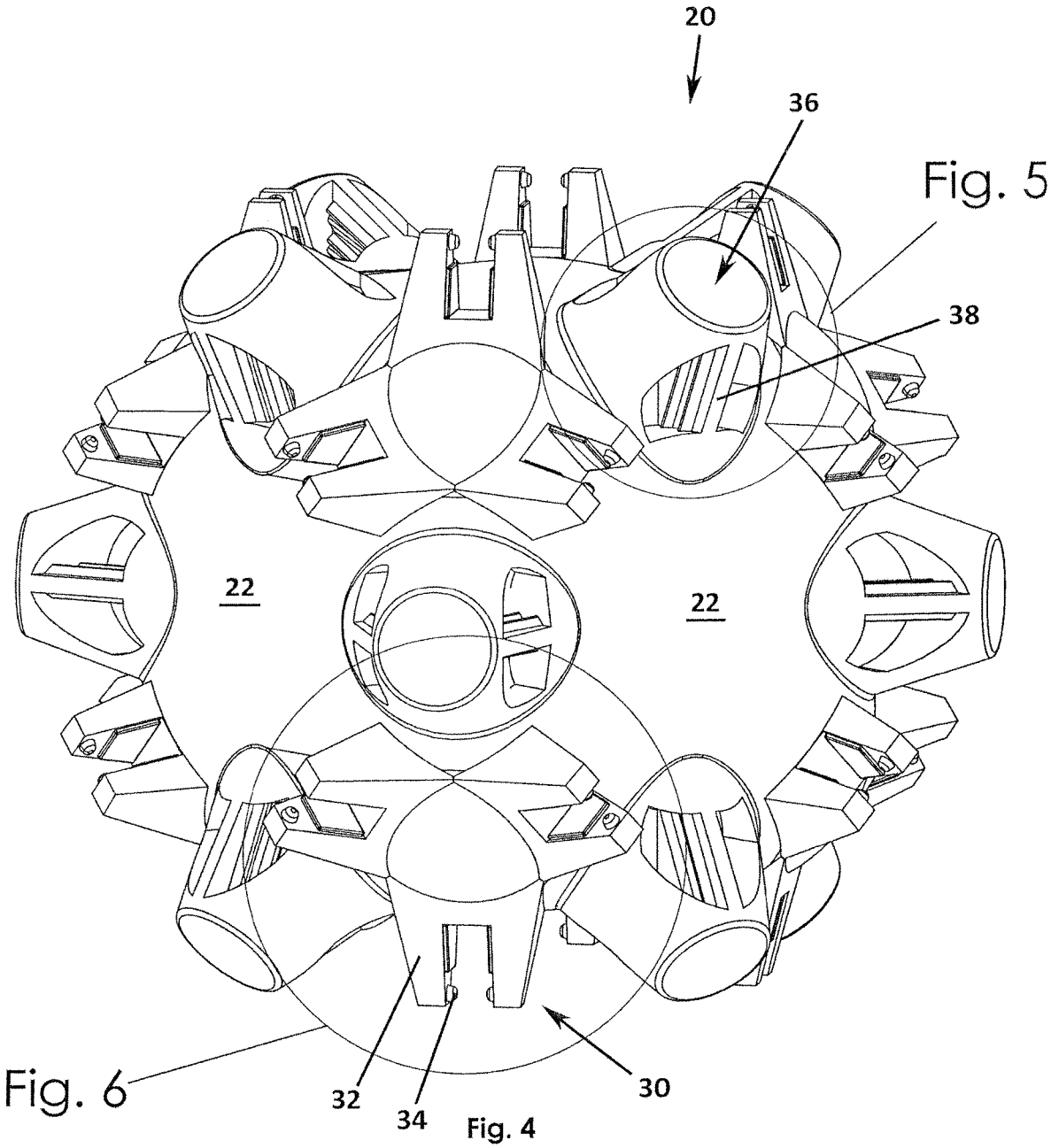
FIG. 4 is another perspective view of the building block as in FIG. 3 although rotated.
FIG. 5 is an isolated view on an enlarged scale taken from FIG. 4.
FIG. 6 is an isolated view on an enlarged scale taken from FIG. 4.
Figure 5:
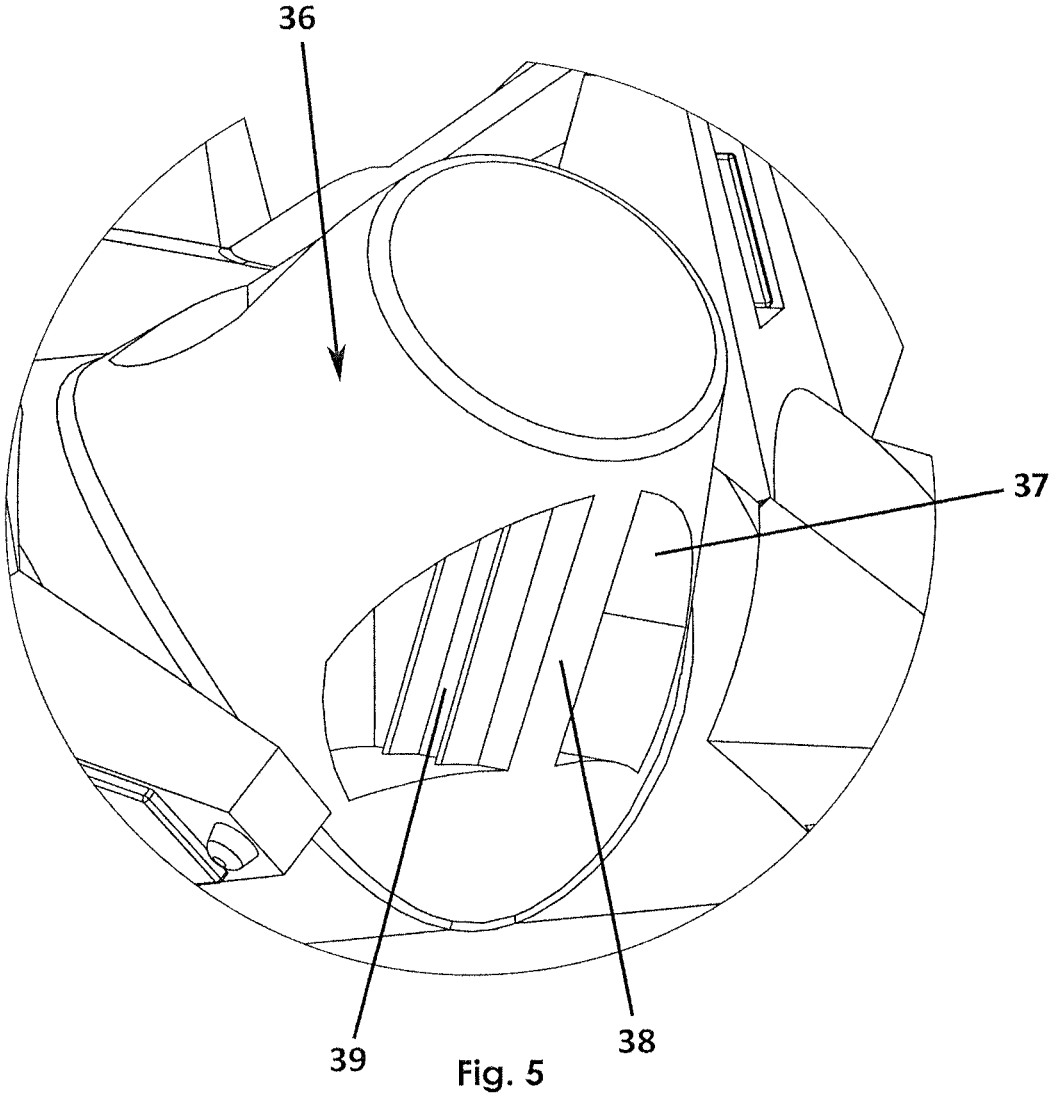
Figure 6:
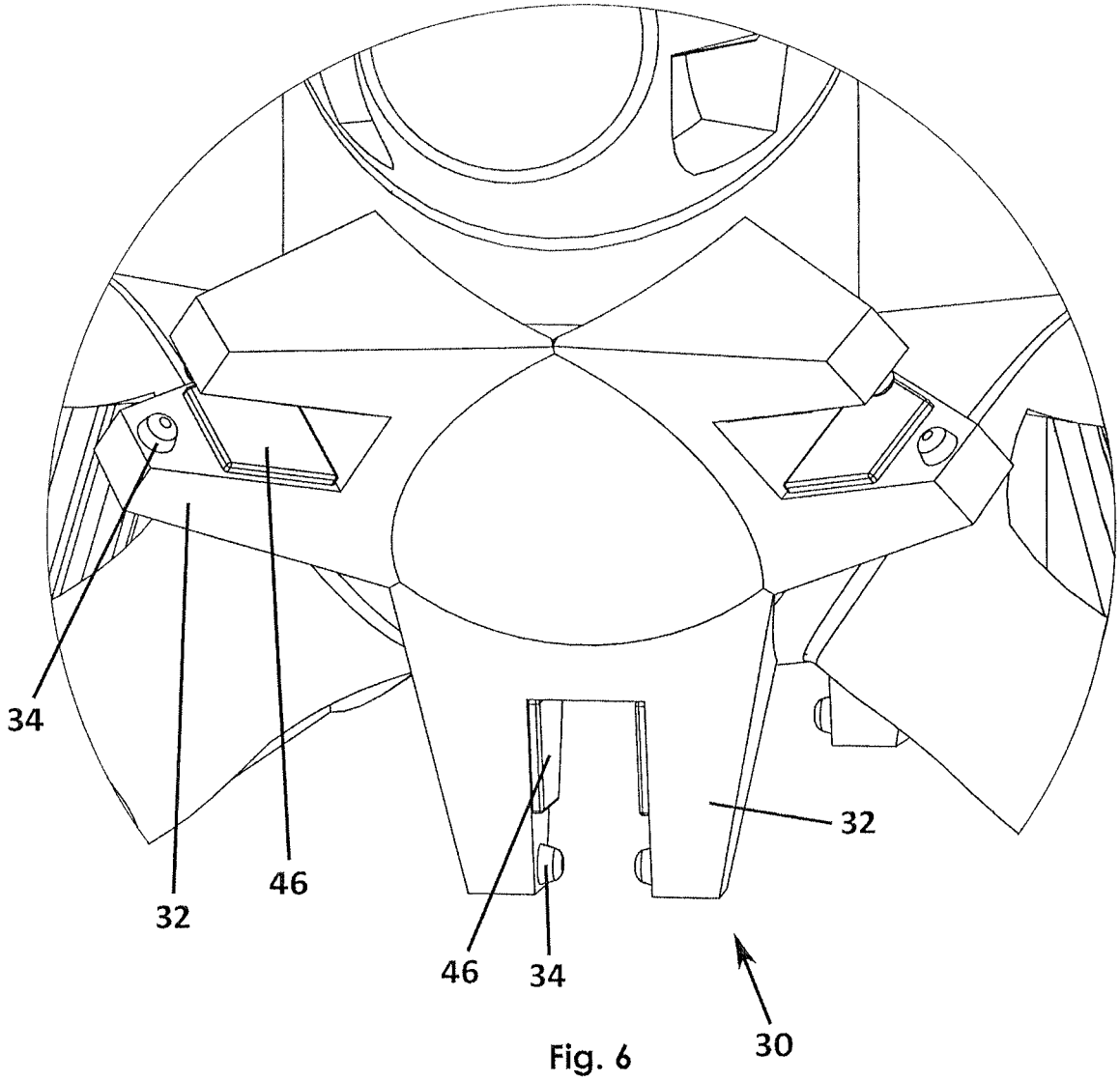
Figure 7:
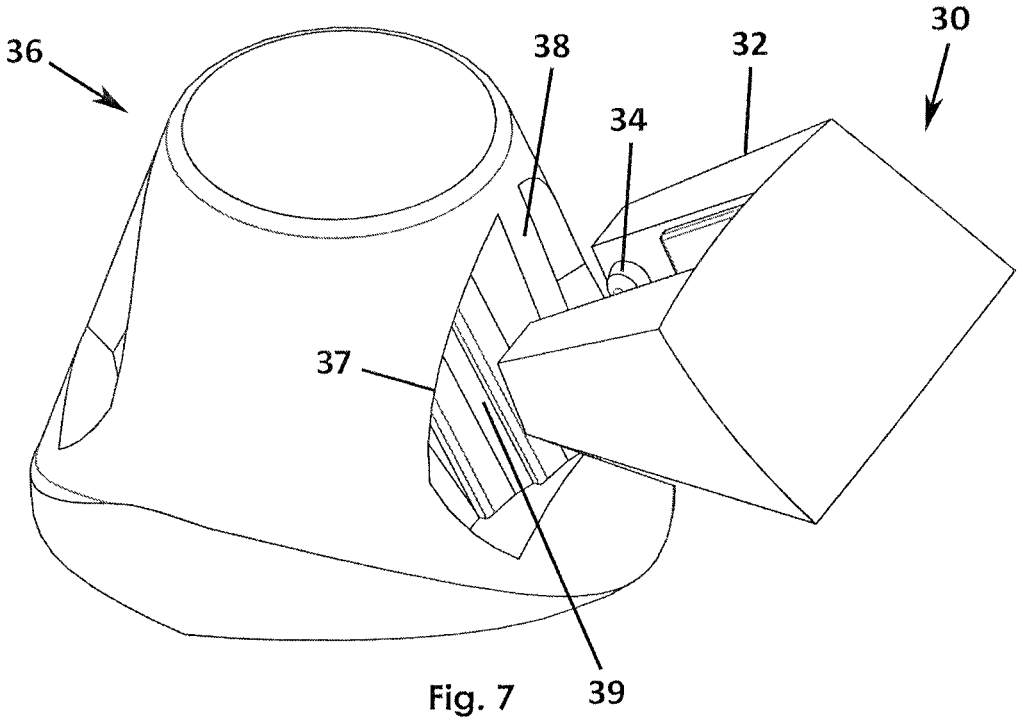
FIG. 7 is a fragmentary isolated view of a connector member of one building block prior to being received by a receiver member of another building block.
Figure 8:
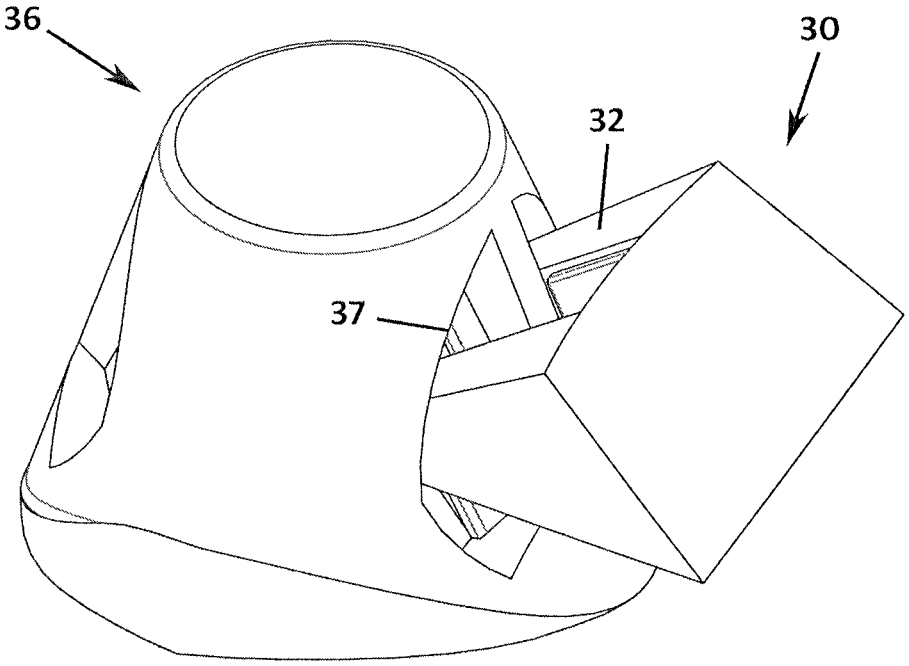
FIG. 8 is a fragmentary isolated view of a connector member of one building block having been received by a receiver member of another building block.
Figure 9:
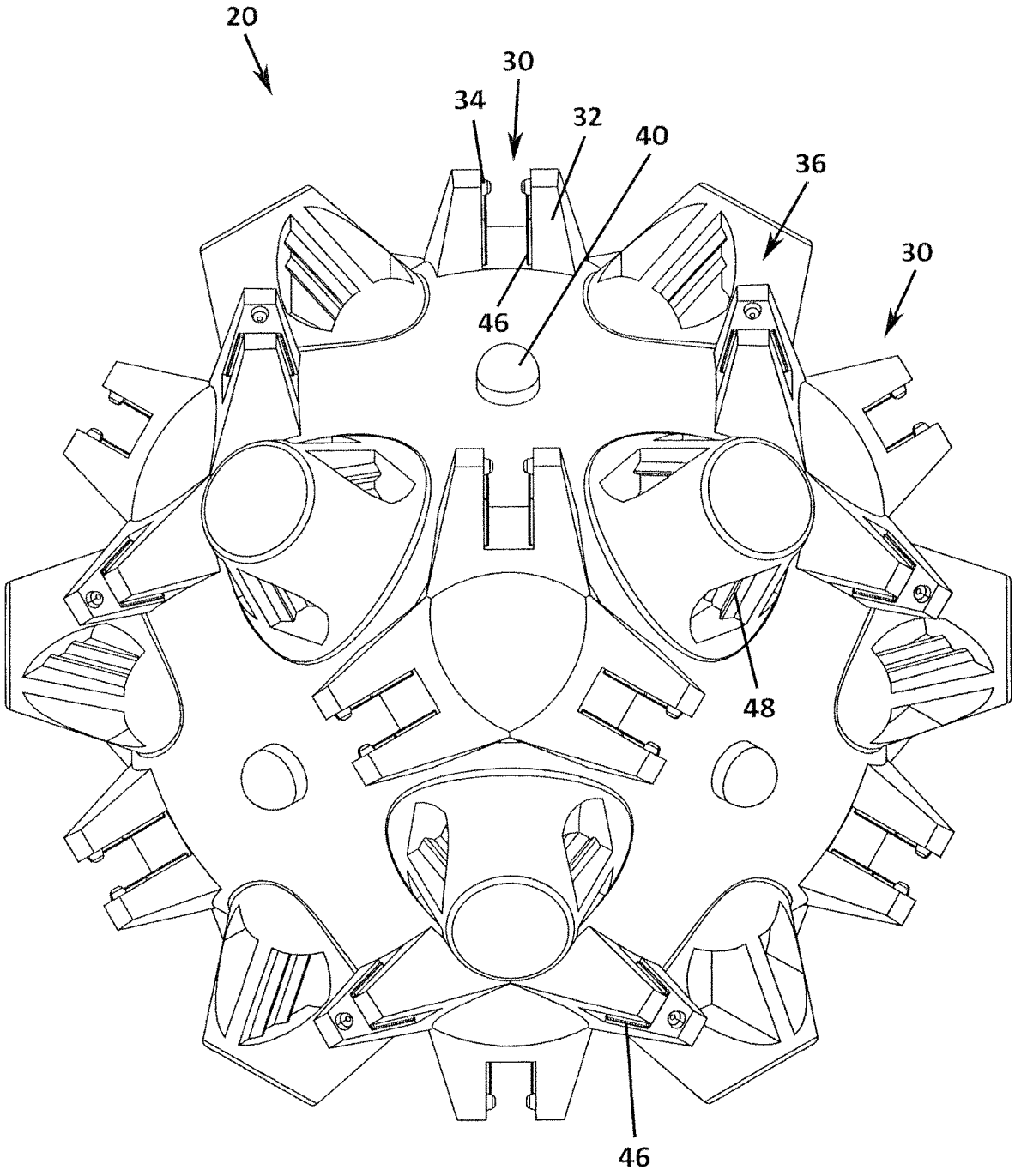
FIG. 9 is a perspective view of the building block system as in FIG. 1, specifically illustrating a lighting element mounted to a block body.
Figure 10:
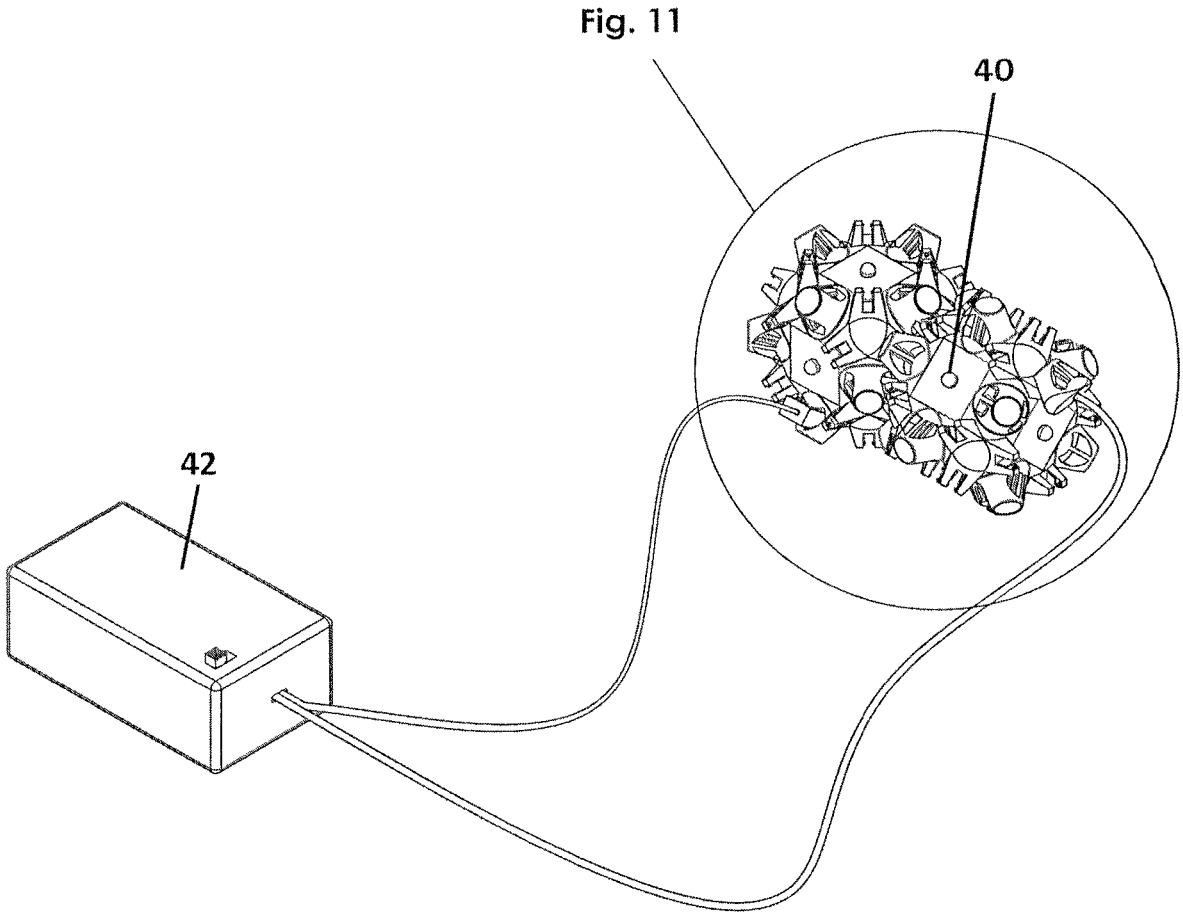
FIG. 10 is a perspective view of the building block system connected to an electrical power supply.
Figure 11:
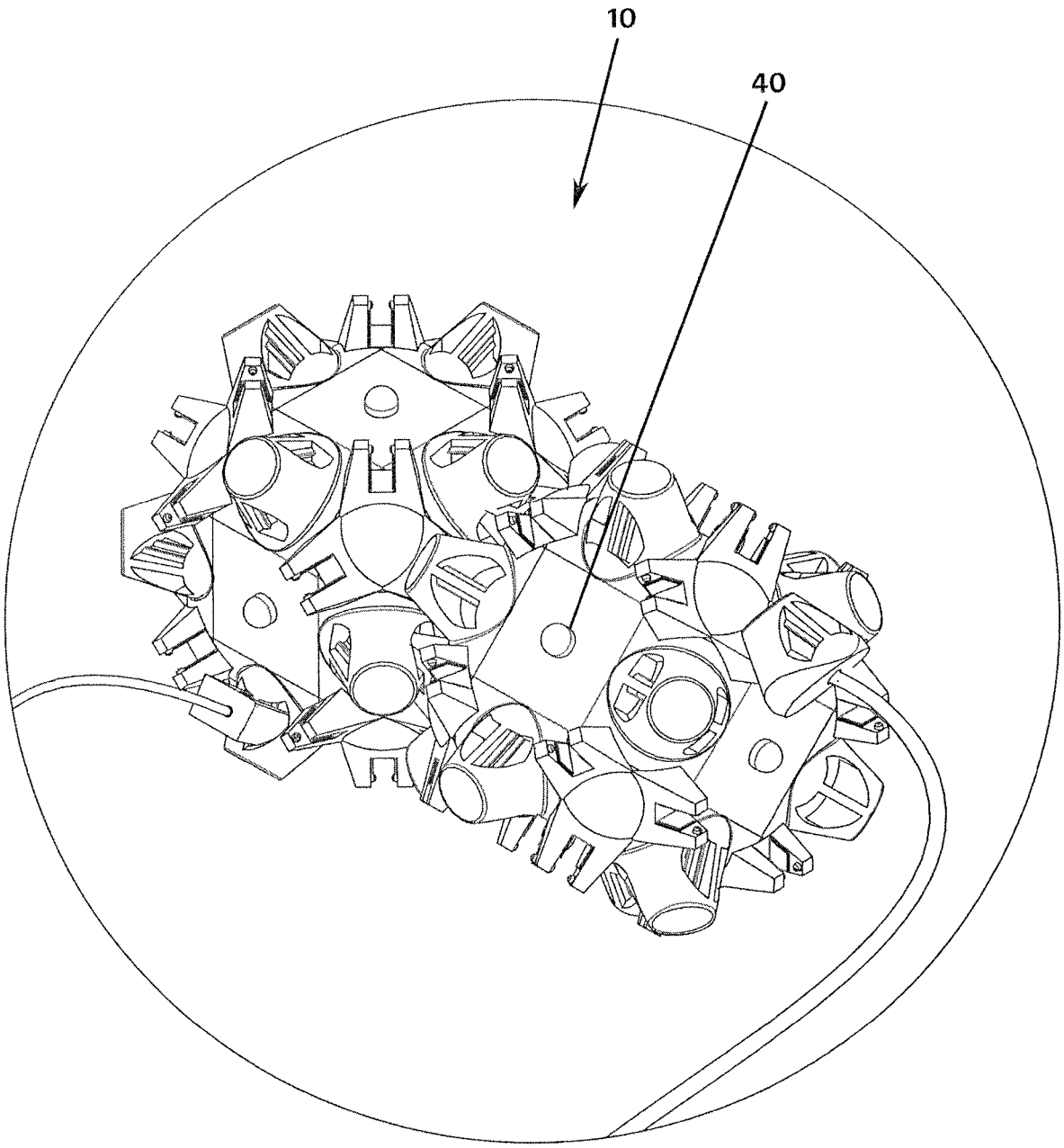
FIG. 11 is an isolated view on an enlarged scale taken from FIG. 10.
Figure 12:
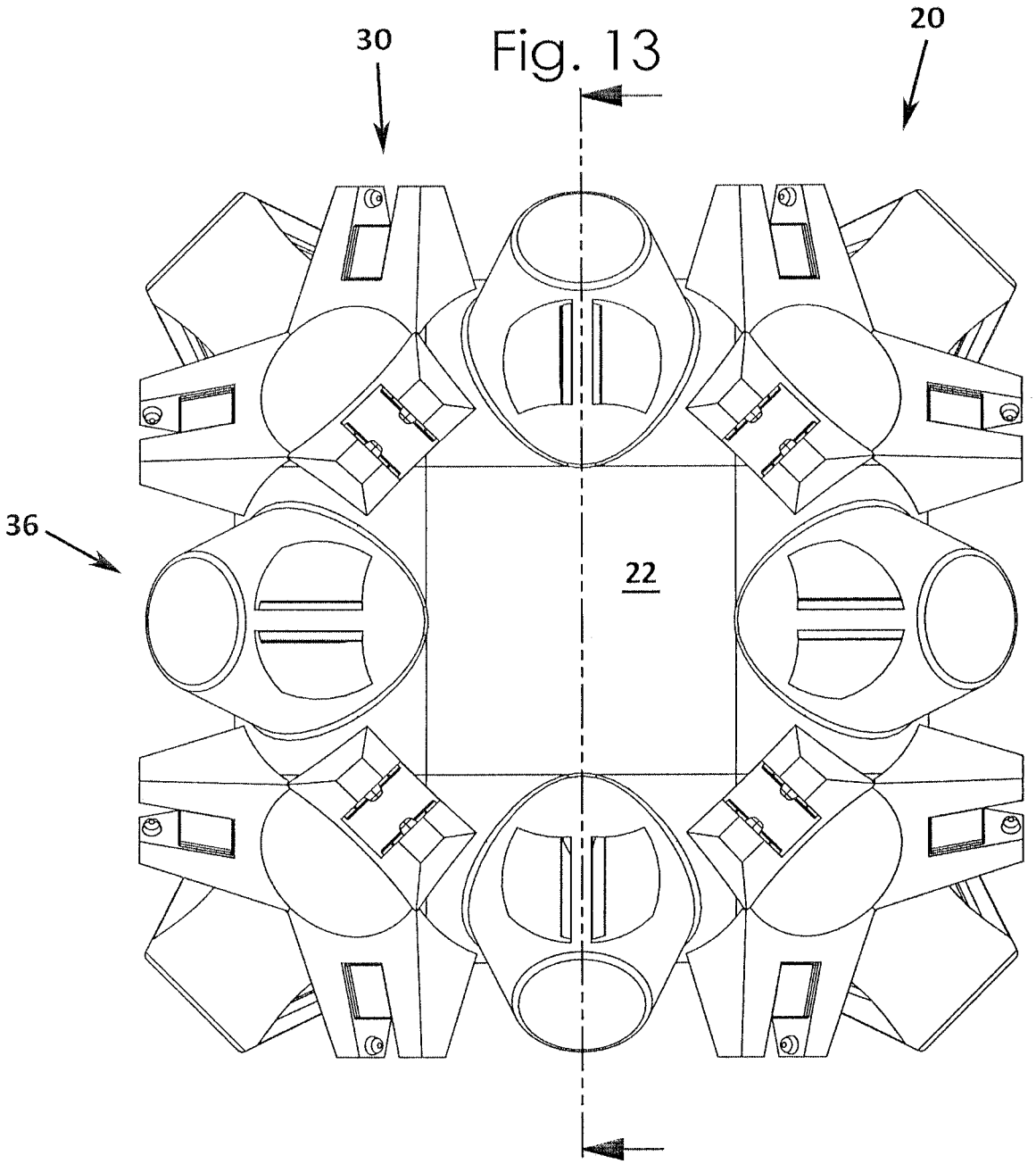
FIG. 12 is a side view of the building block as in FIG. 3.
Figure 13:
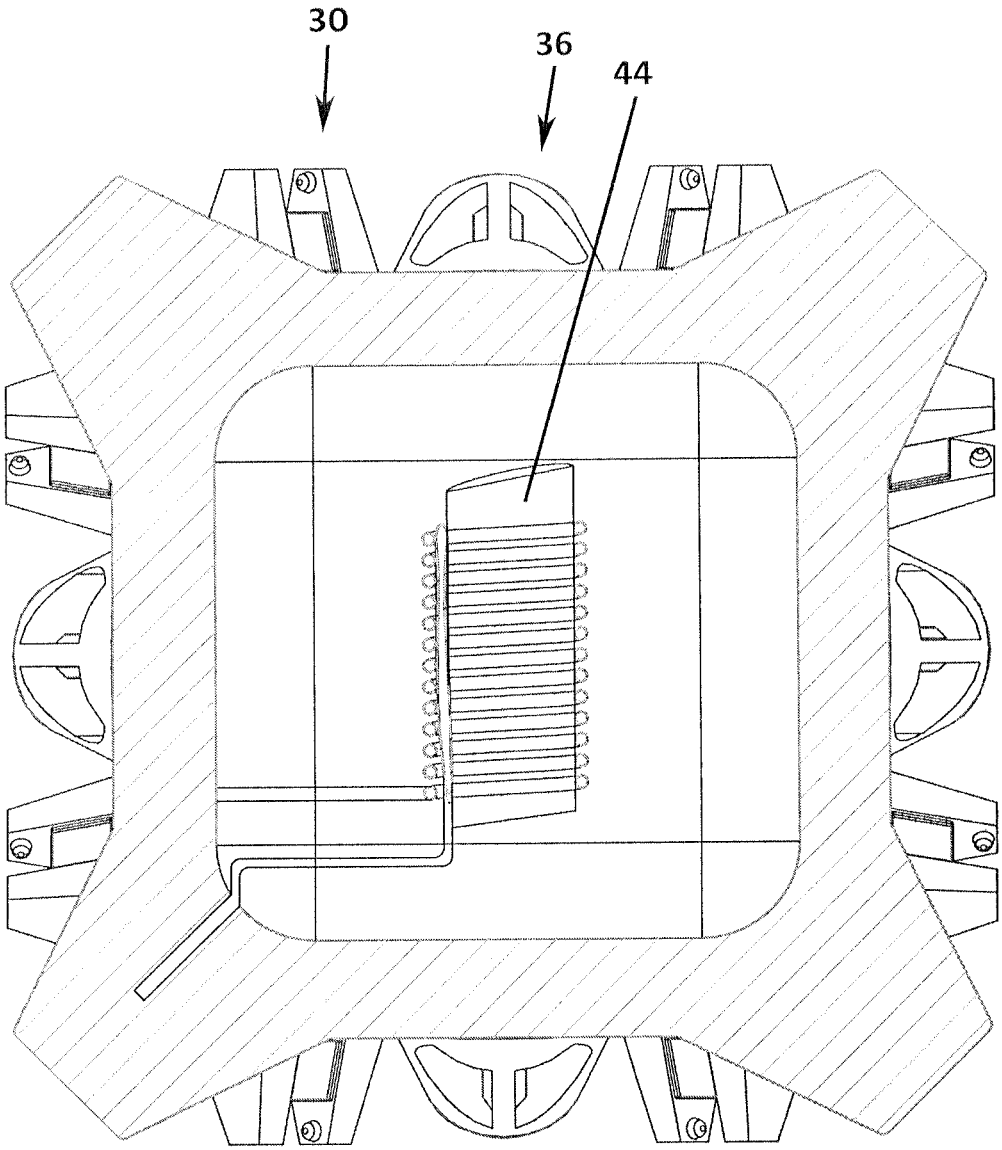
FIG. 13 is a sectional view taken along line 13-13 of FIG. 12.
Figure 14:
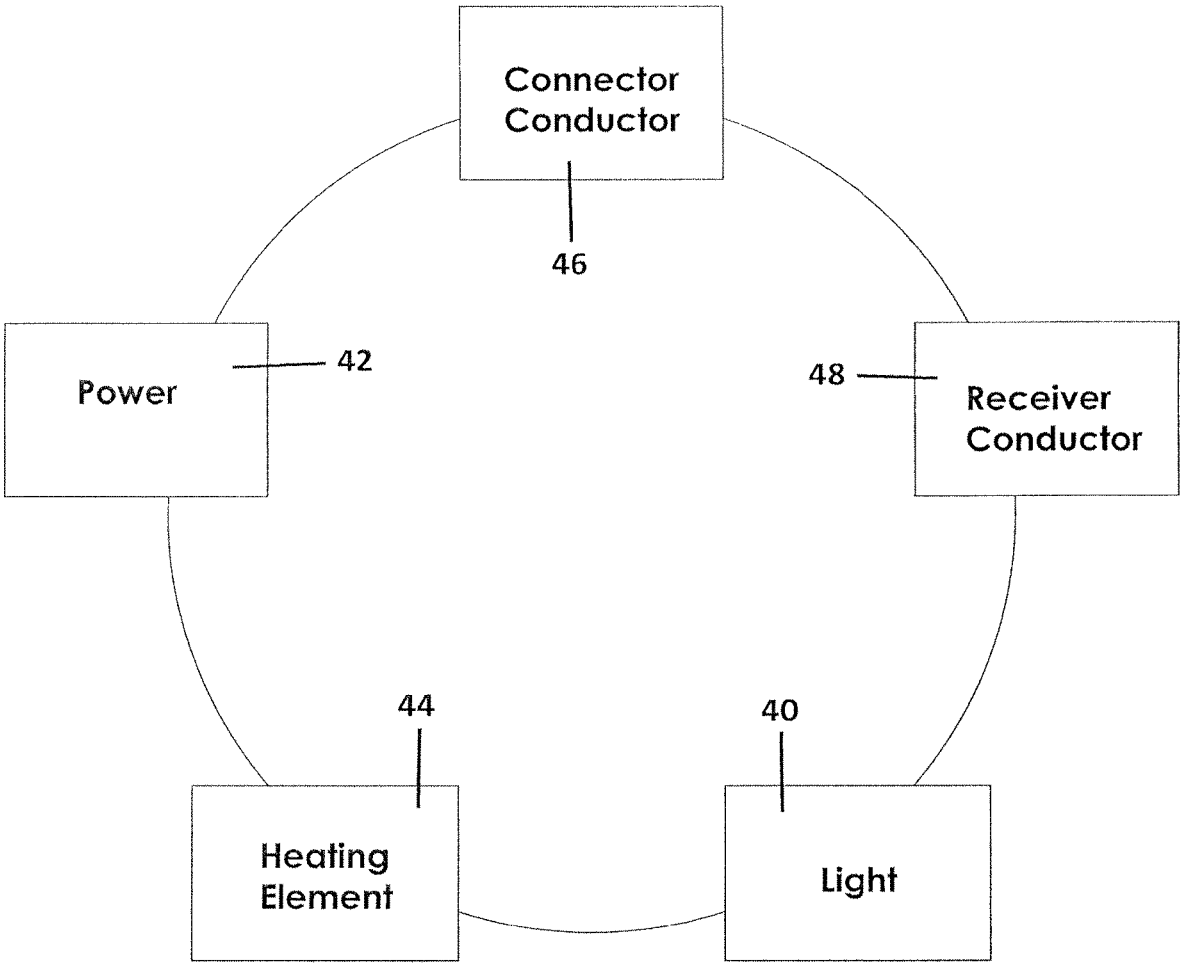
FIG. 14 is a block diagram illustrating the connection and relationship of electronic components according to the present invention.

Now, one or more connector member 30 is positioned and extends away from each respective corner portion 28. Preferably, three of the connector members 30 are coupled to each corner portion 28, the respective prongs of each connector portion extending in a different direction. Each group of three connector members 30 (and, likewise, each corner portion 28) is situated between a set of three adjacent receiver members 36 (FIG. 3).

In another aspect, each building block 20 may include a lighting element 40 and, therefore, may include electrically conductive components and be electrically connected to an electrical power source 42. More particularly, each of the connector members 30 includes a conductive element 46, such as a metal tab. Similarly, each of the receiver members 36 includes a conductive element 48, such as a metal tab. The conductive elements 46, 48 may be electrically connected with traditional wiring (not shown). Further, the power source may be a battery (DC power) or a connection to a traditional electrical socket (AC power) and connected to respective conductive elements to form a circuit. Further, the lighting element 40, which may be a single light emitting diode (LED) or a plurality of LED's, may be positioned on a respective block face(s) and electrically connected to the wiring interconnecting the conductive elements and power source 42.

In an embodiment, a heating element 44 may be situated on or inside the block body and electrically connected to the power source 42. When energized, the heating element 44, which may be a heating coil achieves a temperature sufficiently high to melt (or smelt) plastic such that portions of multiple building blocks 20 may be fused together and, as a result, permanently coupled together. However, heating elements other than an electrical coil may be included, especially if the block body is made of a metal material on which a simple electrical coil may not work. It will be understood that operation of the heating element 44 may be reserved only for use at the point of manufacture and assembly or may be available to be actuated by an end user, such as if the present building block system 10 is marketed and sold as a kit.

In use, the building block system 10 provides a source of entertainment and aesthetic appreciation to a consumer. A building block 20 may singly be manipulated, viewed, and displayed in many orientations and the planar faces may include indicia such as company names, monograms, or advertising. Further, a plurality of building blocks 20 may be coupled together, specifically by engaging a selected connector member 30 to a respective receiver member 36 as described above. In an embodiment, a lighting element 40 may be illuminated.

It is understood that while certain forms of this invention have been illustrated and described, it is not limited thereto except insofar as such limitations are included in the following claims and allowable functional equivalents thereof.

The invention claimed is:

1. A building block system, comprising:

a block body having four side faces offset about 90 degrees from an adjacent side face and having a side edge intermediate two adjacent side faces;

wherein said block body includes a top face perpendicular to said four side faces and a bottom face opposite and parallel to said top face that is perpendicular to said four side faces, said top face and said bottom face having a plurality of upper edges and a plurality of lower edges, respectively, intermediate said four side faces, respectively;

a plurality of receiver members, a single receiver member positioned on a respective said side edge and on a respective said upper edge and on a respective said bottom edge;

a plurality of connector members positioned intermediate said plurality of receiver members, respectively;

wherein each receiver member has a configuration operable to receive a respective connector member in a locking engagement.

2. The building block system as in claim 1, wherein:

said four side faces, said upper face, and said bottom face have a unitary construction in the form of a cube;

said plurality of side edges, said plurality of upper edges, and said plurality of lower edges define a contour of said four side faces, said upper face, and said bottom face.

3. The building block system as in claim 2, wherein:

said block body includes a plurality of corner portions, said plurality of corner portions including an upper corner portion being formed at each intersection of two adjacent upper edges and a respective side edge intermediate said two adjacent upper edges and a lower corner portion being formed at each intersection of two adjacent lower edges and a respective side edge intermediate said two adjacent lower edges;

each of said plurality of corner portions has a flattened or rounded configuration.

4. The building block system as in claim 3, wherein each corner portion includes three connector members of said plurality of connector members.

5. The building block system as in claim 1, wherein:

each connector member includes a pair of prongs displaced from one another and extending outwardly;

each receiver member includes a housing defining an interior area and a pair of apertures separated by a divider and operable to receive said pair of prongs into said interior area in a locking engagement.

6. The building block system as in claim 5 wherein each prong includes a nub extending inwardly.

7. The building block system as in claim 6, wherein each housing of a respective receiver member includes an inner surface defining at least one ridge configured to operably receive a respective nub of a respective prong of a respective connector member.

8. The building block system as in claim 1, wherein:

each of said connector members includes a conductive element;

each of said receiver members includes a conductive element;

said plurality of conductive elements of said plurality connector members and said plurality of receiver members, respectively, are electrically connected;

said building block system further comprising:

a power source electrically connected to at least one conductive element of a respective connector member;

a lighting element coupled to one of said side faces, said top face, or said bottom face and electrically connected to said power source and operable to emit light when energized.

9. The building block system as in claim 1, further comprising:

a heating element situated in an open space defined by said body block; and a power source electrically connected to said heating element.

10. The building block system as in claim 1, wherein said block body is a plurality of block bodies, a respective connector member of a first block body being releasably coupled to a respective receiver member of a second block body.

11. A building block system, comprising:

a plurality of building blocks in which a first building block is selectively coupled to a next building block, and so on;

wherein a respective building block includes a block body having four side faces offset about 90 degrees from an adjacent side face and having a side edge intermediate two adjacent side faces;

wherein said block body of said respective building block comprises:

a top face perpendicular to said four side faces and a bottom face opposite and parallel to said top face that is perpendicular to said four side faces, said top face and said bottom face having a plurality of upper edges and a plurality of lower edges, respectively, intermediate said four side faces, respectively;

a plurality of receiver members, a single receiver member positioned on a respective said side edge and on a respective said upper edge and on a respective said bottom edge;

a plurality of connector members positioned intermediate said plurality of receiver members, respectively;

wherein each receiver member has a configuration operable to receive a respective connector member in a locking engagement.

12. The building block system as in claim 11, wherein:

said four side faces, said upper face, and said bottom face have a unitary construction in the form of a cube;

said plurality of side edges, said plurality of upper edges, and said plurality of lower edges define a contour of said four side faces, said upper face, and said bottom face; and said plurality of connector members and said plurality of receiver members extend away from an outer surface of said cube.

13. The building block system as in claim 12, wherein:

said block body includes a plurality of corner portions, said plurality of corner portions including an upper corner portion being formed at each intersection of two adjacent upper edges and a respective side edge intermediate said two adjacent upper edges and a lower corner portion being formed at each intersection of two adjacent lower edges and a respective side edge intermediate said two adjacent lower edges;

each of said plurality of corner portions has a flattened or rounded configuration.

14. The building block system as in claim 13, wherein three connector portions of said plurality of connector portions extend away from each corner portion of said block body, respectively.

15. The building block system as in claim 11, wherein:

each connector member includes a pair of prongs displaced from one another and extending outwardly, said pair of prongs have a semi-flexible construction;

each receiver member includes a housing defining cavity and a pair of apertures separated by a divider and operable to receive said pair of prongs into said cavity in a locking engagement.

16. The building block system as in claim 15 wherein each prong includes a nub extending inwardly.

17. The building block system as in claim 16, wherein each housing of a respective receiver member includes an inner surface defining at least one ridge configured to operably receive a respective nub of a respective prong of a respective connector member.

18. The building block system as in claim 11, wherein:

each of said connector members includes a conductive element;

each of said receiver members includes a conductive element;

said plurality of conductive elements of said plurality connector members and said plurality of receiver members, respectively, are electrically connected;

said building block system further comprising:

a power source electrically connected to at least one conductive element of a respective connector member; and a lighting element coupled to one of said side faces, said top face, or said bottom face and electrically connected to said power source and operable to emit light when energized.

19. The building block system as in claim 11, further comprising:

a heating element situated in an open space defined by said body block; and a power source electrically connected to said heating element.

* * * * *